United States Patent [19]

Camosso et al.

[11] Patent Number: 4,610,225

[45] Date of Patent: Sep. 9, 1986

[54] HYDRAULIC TAPPET FOR CONTROLLING AN INTERNAL COMBUSTION ENGINE VALVE

[75] Inventors: Domenico Camosso, Turin; Silvio Ragazzoni, Pino Torinese; Franco Colanzi, Turin, all of Italy

[73] Assignee: RIV-SKF Officine di Villar Perosa, SpA, Turin, Italy

[21] Appl. No.: 716,246

[22] Filed: Mar. 26, 1985

[30] Foreign Application Priority Data

Mar. 27, 1984 [IT] Italy ..... 67294 A/84

[51] Int. Cl.[4] ..... F01L 1/24

[52] U.S. Cl. ..... 123/90.55; 123/90.58

[58] Field of Search ..... 123/90.12, 90.48, 90.56, 123/90.55, 90.57, 90.58

[56] References Cited

U.S. PATENT DOCUMENTS 4,373,477 2/1983 Buente et al. ..... 123/90.55

FOREIGN PATENT DOCUMENTS 0030781 6/1981 European Pat. Off. ..... 123/90.55
2089923 6/1982 United Kingdom ..... 123/90.55
2093940 9/1982 United Kingdom ..... 123/90.55

*Primary Examiner*—Craig R. Feinberg
*Assistant Examiner*—David A. Okonsky
*Attorney, Agent, or Firm*—Morgan & Finnegan

[57] ABSTRACT

There is disclosed a hydraulic tappet comprising a bucket element which slides inside a seat and houses a second bucket element that slides over an annular member integral with the first bucket element in such a manner as to form a first chamber. A deformable annular element is arranged around the second bucket element in such a manner so as to form a second fluid tight chamber connected hydraulically to the first chamber. The chambers are filled with drive fluid and the passage of the fluid from the second chamber to the first chamber is controlled by an on-off member.

10 Claims, 6 Drawing Figures

HYDRAULIC TAPPET FOR CONTROLLING AN INTERNAL COMBUSTION ENGINE VALVE

BACKGROUND OF THE INVENTION

The present invention relates to a hydraulic tappet designed for assembly on a drive for controlling a valve on an internal combustion engine.

Hydraulic tappets designed for assembly on a drive for controlling a valve on an internal combustion engine are known usually to comprise a first element, moving in relation to the crankcase, and a second element moving axially in relation to the first. Between the two elements there is formed a first chamber of varying volume having an inlet duct for drive fluid, the aperture of the inlet duct being controlled by an on-off member in such a manner that the fluid flowing into the chamber causes one of the elements to move axially in relation to the other, so as to vary the volume inside the chamber and so recover any slack on the gear chain on the drive.

The first variable-volume chamber usually communicates through appropriate ducts with a suitable drive fluid source.

The drawback of tappets of the aforementioned type is that they operate poorly at the initial engine operating stage, since the oil contained in the chamber, when the engine is off, seeps out or leaks out of the chamber between the mating surfaces of the first and second moving elements, and also due to the fact that, at the initial operating stage, the oil pressure on the engine is so low as to be incapable of ensuring an adequate oil supply to the chamber itself.

In some known tappets, the aforementioned drawbacks have been partially overcome by providing a second drive fluid chamber communicating hydraulically with the first and in which second chamber a given amount of drive fluid is preserved, retained or maintained even when the engine is left idle, thus enabling the first chamber to be filled more easily, when the engine is started up, than in the foregoing arrangement.

Even on these tappets, however, long-term operation of the engine may result in oil leaking from the second chamber to the extent that operation of the tappet is seriously jeopardized. Furthermore, leakage between the mutually-sliding mating surfaces on the two sliding elements is not prevented by providing appropriate sealing members between the surfaces.

SUMMARY OF THE INVENTION

The aim of the present invention is to provide a hydraulic tappet of the aforementioned type which does not exhibit the aforementioned drawbacks, i.e. one providing for a high degree of reliability, for correct operation even at the initial engine operation stage and no maintenance. A further feature of the tappet according to the present invention is that it is highly compact with a straighforward structure enabling low-cost production. With these aims in view, the present invention relates to a hydraulic tappet designed for assembly on a drive for controlling a valve on an internal combustion engine having a crankcase, the tappet comprising a first element, moving in relation to the crankcase, and a second element moving axially in relation to the first element; a first variable-volume chamber being formed between the said first and second elements with an inlet duct for drive fluid; the duct being controlled by an on-off member in such a manner that the fluid flowing into the chamber causes one of the elements to move axially in relation to the other so as to vary the volume of the chamber itself, characterized by the fact that the second element comprises a bucket element, connected by means of a sliding connection to a sliding annular member integral with the first element so as to form the first chamber between the bucket element and the sliding element, and an annular element made of deformable material and arranged around the bucket element and the sliding annular member so as to form a second annular chamber for the drive fluid connected hydraulically to the first chamber; the annular element of deformable material having a first and second annular edge connected in sealed manner to the first and second moving elements respectively; and the sliding connection essentially communicating hydraulically with the second chamber.

The tappet according to the present invention also comprises elastic means designed to keep the annular element of deformable material in a first normally-deformed position in which the volume of the second chamber is minimum, in such a manner as to cause the drive fluid to flow from the second chamber into the first chamber.

THE DRAWINGS

The present invention will now be described in more detail by way of a non-limiting example, the description to be taken in conjunction with the attached drawings wherein.

Figure 3A:
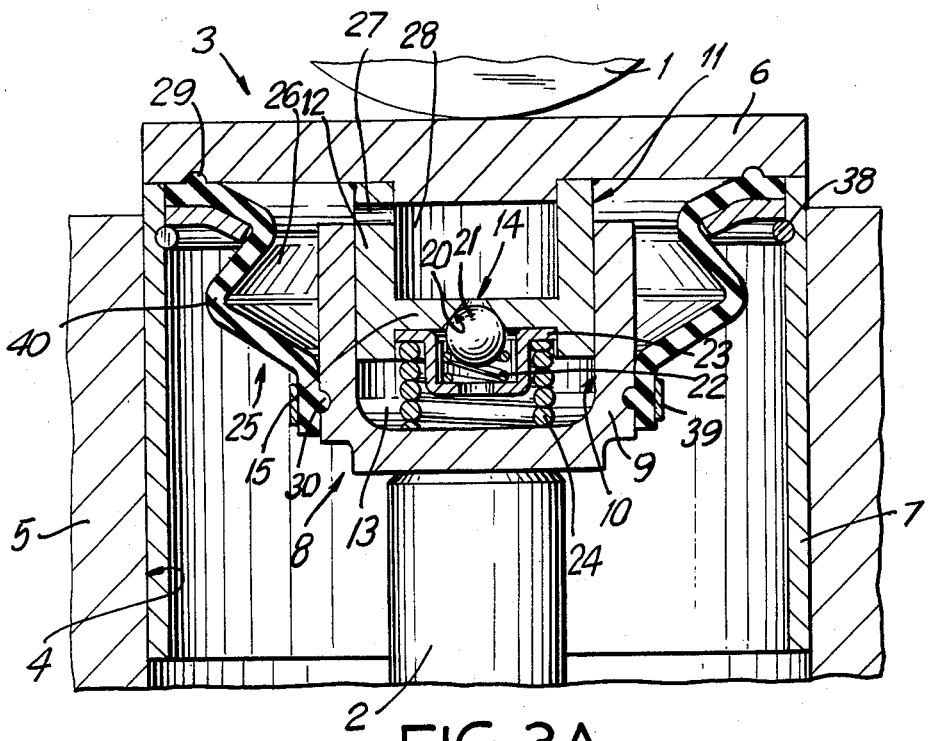
Figure 3B:
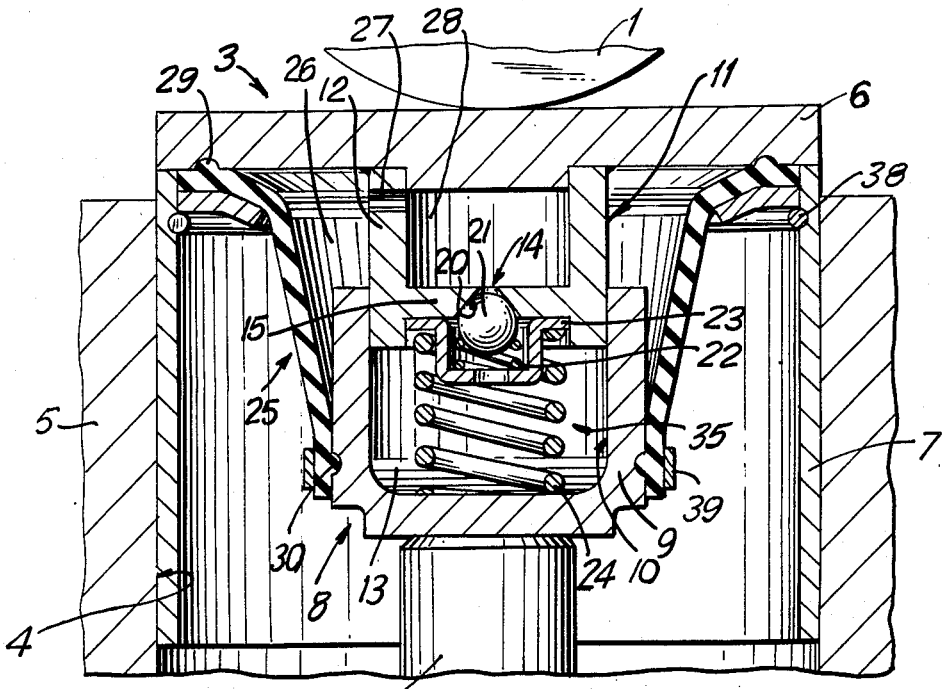
Figure 4:
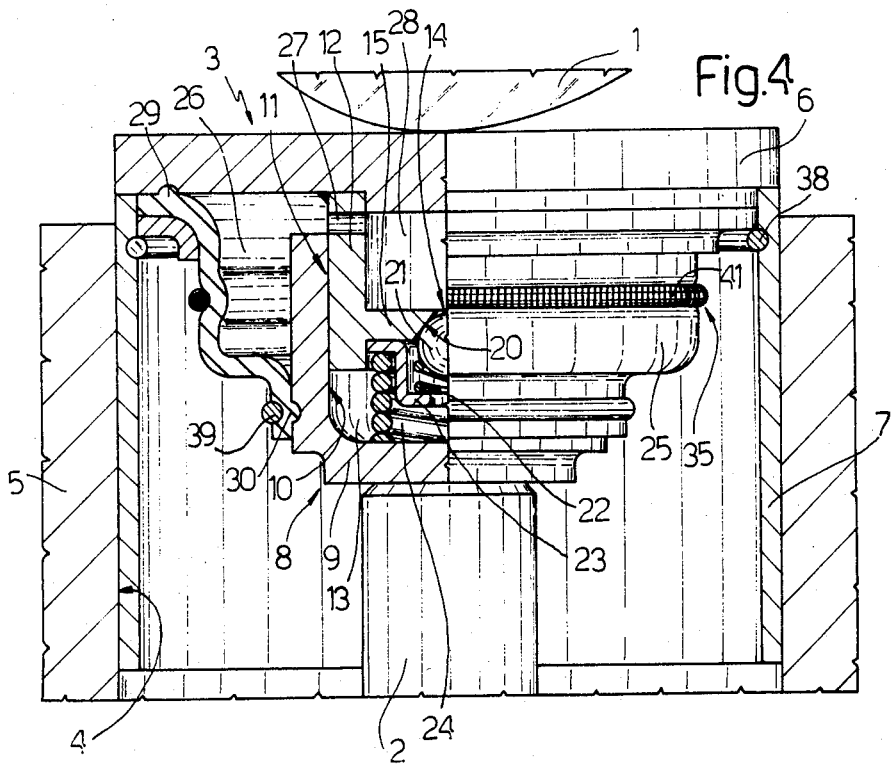

FIG. 3A is an axial section of a second arrangement of a tappet according to the invention showing a first variable volume chamber 13 in minimum volume position and in which annular element 25 is specifically designed to have at least one annular undulution which forms an L-shaped fold in section when chamber 26 is at maximum volume;

FIG. 3B is an axial section of the tappet shown in FIG. 3A showing a first variable volume 13 in maximum volume position and in which annular element 25 has an essentially conical shape when chamber 26 is at minimum volume; and FIG. 4 is an axial section of a third arrangement of a tappet according to the invention in which annular element 25 is essentially cylindrical in shape and elastic means 35 is a helical spring in the form of a ring exerting radial pressure on the outer surface of the element to hold it in a position in which the volume of chamber 26 is at a minimum.

DETAILED DESCRIPTION OF THE INVENTION

Figure 1A:
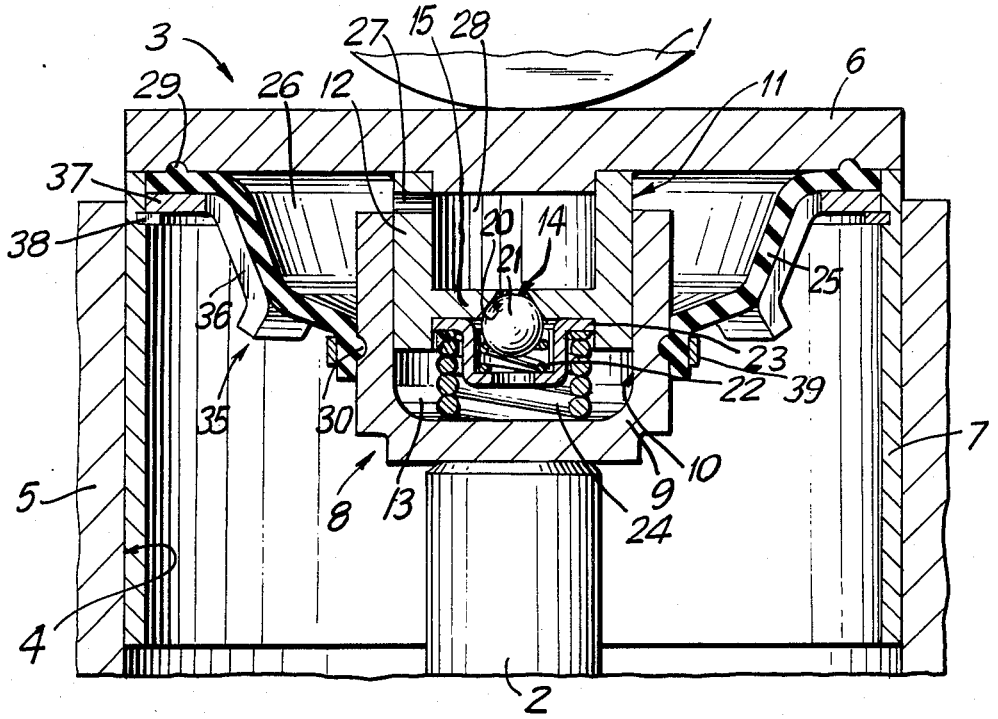
FIG. 1A is an axial section of a first arrangement of a tappet according to the present invention showing a first variable volume chamber 13 in minimum volume position.

With reference to FIG. 1A, a tappet according to the present invention is designed for assembly on a drive for controlling a valve on an internal combustion engine. FIG. 1A shows only part of a drive cam 1 and of the valve, only the end part of rod 2 on the same. The tappet according to the present invention essentially comprises a first moving element indicated as a whole by 3 which moves inside an essentially cylindrical seat 4 formed in crankcase 5. According to the arrangement shown in the attached drawings, the first moving element essentially comprises an end wall in the shape of an essentially flat plate 6 designed to contact the working surface of cam 1 and an essentially cylindrical side wall 7 the outer surface of which mates in sliding manner with surface 4 on crankcase 5.

The tappet according to the present invention also comprises a second moving element 8 moving axially in relation to the first moving element 3. In the arrangement shown, the second moving element is shaped essentially in the form of a bucket 9 the essentially cylindrical inner surface 10 of which mates in sliding manner with the outer surface 11 of a sleeve-shaped sliding member 12 that is integral with the first moving element 3. The sliding member may be made in one piece with plate 6 of the first moving element 3, as shown in the FIG. 2, or it may be connected to the plate in any convenient manner, e.g. welded, as shown in the FIG. 1A arrangement.

Between the first and second moving elements, 3 and 8, respectively, a first variable-volume chamber 13 is defined with an inlet duct for drive fluid, the comprising a hole 14 formed in end wall 15 of sliding member 12.

Figure 2:
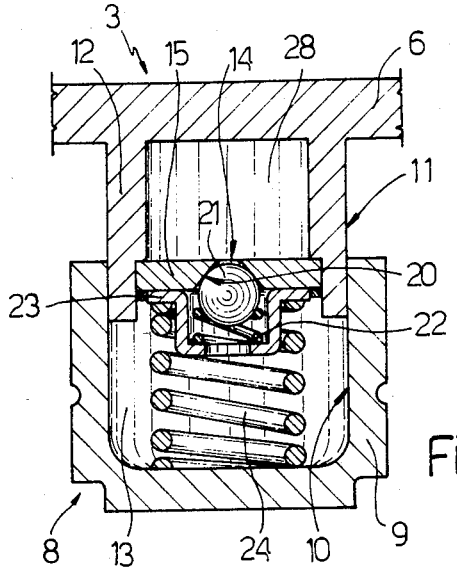
FIG. 2 shows a variation of the embodiment of the tappet illustrated in FIGS. 1A and 1B and in which the end wall 15 on sliding member 12 is fixed thereto by welding.

The wall may be formed in one piece with the member (as shown in FIG. 1A) or it may be fitted to the member 12 in any convenient manner, e.g. welded, as shown in FIG. 2.

Hole 14 is provided with a seat 20 for an on-off member consisting of, for example, ball 21. The latter is held against the seat by a helical spring 22 housed inside retainer 23, which, in turn, is held against wall 15 by a further spring 24 located between the end wall and bucket 9, as shown clearly in FIG. 1A.

Mating surfaces 10 and 11, on bucket 9 and sliding member 12 respectively, form a sliding connection enabling both axial displacement of the former in relation to the latter and the passage of drive fluid, as described below, between the mating surfaces.

The tappet according to the present invention also comprises an annular element of deformable material indicated as a whole by 25 which is arranged around bucket 9 and sliding member 12 so as to form a second essentially annular chamber 26 for containing the drive fluid and which is connected hydraulically to the first chamber 13 through hole 27 and hole 14. A third chamber 28 is also formed inside sliding member 12, chamber 28 being located over chamber 13 and along the hydraulic route between the other two chambers.

The annular element 25 of deformable material presents first and second annular edges, 29 and 30 respective, connected respectively to end wall 6 of first moving element 3 and to the outer surface of bucket 9.

The tappet according to the present invention also comprises elastic means indicated as a whole by 35 and which is designed to keep the annular element 25 of deformable material in a first normally-deformed position (shown in FIG. 1B) in which the volume of second chamber 26 is minimum, so as to enable the drive fluid to flow from the second chamber into the first chamber as described below.

The elastic means may conveniently comprise a number of flat springs 36 each exerting force on the outer surface of annular element 25 of deformable material and each connected to a ring 37 fitted of the to end wall 6 on first moving element 3. For fitting ring 37, provision may conveniently be made for a retaining ring 38 which, in addition to locking ring 37, also locks the first edge 29 on the element itself. The other edge 30 on the same element may be fitted to bucket 9 in any convenient manner, e.g. by means of clamp 39.

The FIG. 3A arrangement differs from the one above in regard to the shape of annular element 25 of deformable material and the structure of the elastic means 35 for keeping the annular element normally in the first position.

In the FIG. 3A arrangement, annular element 25 of deformable material presents at least one essentially annular undulation 40 designed to form, sectionwise, an L-shaped fold as shown clearly in FIG. 3A. The shape of the deformable element is such as to enable it to assume the position shown in FIG. 3B, in which the undulation is entirely eliminated so as to render the element essentially conical. This position corresponds essentially with the aforementioned first position in which the volume of the second chamber 26 is of a minimum, whereas the position illustrated in FIG. 3A shows chamber 26 at a maximum volume. In the FIG. 3A arrangement, the elastic means for enabling the tappet to switch from the second to the first position consists simply of helical spring 24 inside bucket 9. In the FIG. 4 arrangement, annular element 25 of deformable material is essentially cylindrical in shape and the said elastic means 35 consist of helical spring 41 shaped essentially in the form of a ring so as to exert essentially radial pressure on the outer surface of the element itself and so to hold the element in a position in which the volume of the second chamber 26 is at a minimum. Deformable annular element 25 may be made of any material so long as it is readily deformable, has sufficient chemical resistance to withstand the agents or materials with which it comes into contact in an internal combustion engine and of sufficient fatigue resistance to withstand the cyclic strain the element is subjected to during operation of the tappet. Such material may conveniently be rubber, elastomers or plastics, possibly containing appropriate fillers or reinforced with wire or layers of any type of woven material, e.g. cord, wire mesh, nylon, rayon or similar materials.

The tappet according to the present invention operates as follows.

Figure 1B:
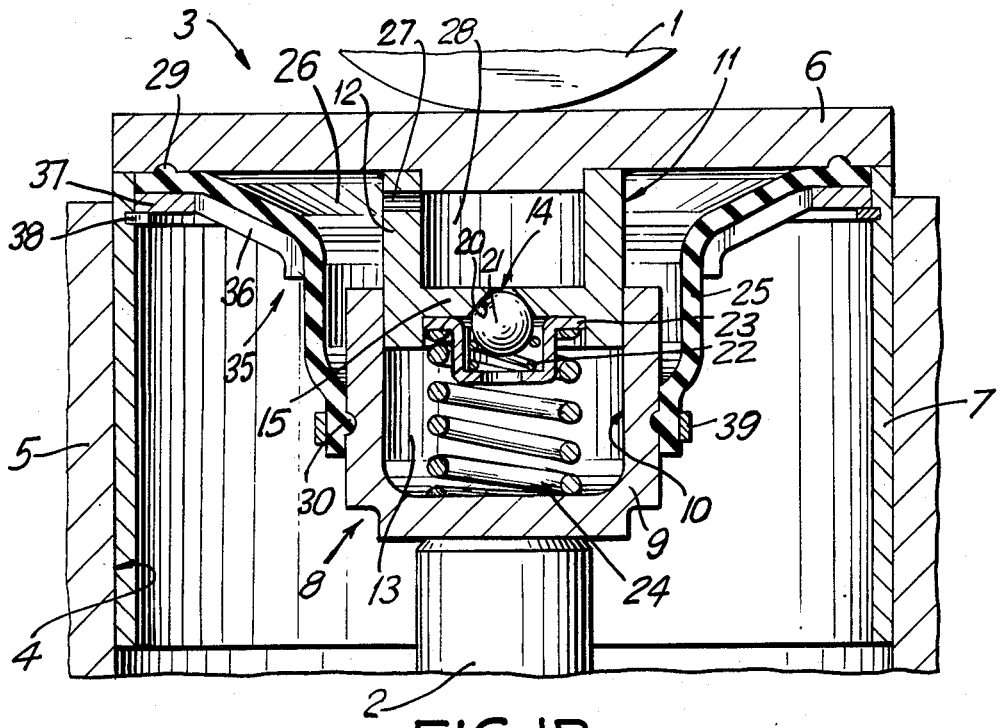
FIG. 1B is an axial section of the tappet shown in FIG. 1A with the first variable volume chamber 13 in maximum volume position.

As shown in the FIG. 1B arrangement, deformable annular chamber 26 is initially filled with a sufficient amount of drive fluid to fill it completely. Chamber 26 need only be filled once before the tappet is fitted on to the engine since, during operation, the sealing action resulting from the manner in which deformable annular element 25 is connected to the other parts on the tappet prevents any possibility of oil leaking from the chamber 26. The oil fill on the tappet must be such as to fill up, not only chamber 26, but also chamber 28 and chamber 13 when the latter is in the minimum-volume position shown in FIG. 1A.

During initial operation of the engine, when the tappet is mounted on the gear chain between cam 1 and rod 2, the slack between the tappet and the other parts is taken up immediately owing to the pressure on the oil in chamber 26 resulting from the force exerted by elastic means 35. Consequently, the oil tends to flow back through hole 27 into chamber 28 and, from there, through hole 14 into first chamber 13 which is filled until bucket 9 contacts cam 2 and wall 6 contacts cam 1.

During operation of the engine, the oil inside first chamber 13 is prevented from flowing back through hole 14 since the latter is closed by ball 21 which is forced against corresponding seat 20. In like manner, any slack between cam 1 and rod 2 is eliminated during operation of the engine. When the engine is left idle for a fairly long period of time, oil may seep into the connection between surfaces 10 on bucket 9 and 11 on sliding member 12, thus enabling oil to flow back into chamber 26. As soon as the engine is started up, however, and even during initial operation when the pressure of the oil circulating in the engine is still low, the tappet may still provide for efficient recovery of the slack on the drive since the pressure of the oil inside chamber 26 is still high enough for it to flow back through into chamber 28 and hole 14 into chamber 13, so as to establish correct contact of bucket 9 and end wall 6 against rod 2 and cam 1, respectively.

Clearly, therefore, the tappet according to the present invention provides for efficient operation even at low engine speed and even as soon as the engine is started up, since the pressure of the oil inside chamber 26 is always high enough for the oil to flow into chamber 13. The tappet according to the present invention also provides for maximum reliability since the hydraulic conditions established at the initial construction stage remain essentially unchanged during operation of the tappet itself. In fact, any possibility of oil leaking from the tappet is prevented since none of the sliding connections, and particularly the one between surfaces 10 and 11, communicate externally of the tappet, but rather communicate solely with the inside of chamber 26 containing the drive fluid.

The tapped of the present invention also has a highly compact, straightforward structure enabling lowcost production.

To those skilled in the art it will be clear that changes may be made to the arrangements described herein without, however, departing from the scope of the present invention. In particular, the shape of deformable annular element 25 may be other than as described herein, and provision may be made for different elastic means for exerting pressure so as to deform the element and keep the drive fluid in chamber 26 inside the element essentially under pressure.

We claim:

1. A hydraulic tapped designed for assembly on a drive and for controlling a valve on an internal combustion engine having a crankcase, said tappet comprising a first element moving in relation to said crankcase and a second element moving axially in relation to said first element; a first variable-volume chamber having an inlet duct for passage of drive fluid being formed between said first and said second elements, said inlet duct being controlled by an on-off member in such a manner that the fluid flowing into the chamber causes one of said elements to move axially in relation to the remaining element and to vary the volume of said chamber, said second element comprising a bucket element connected by means of a sliding connection to a sliding annular member integral with said first element and to form said first chamber betweem said bucket element and said sliding annular member, an annular element made of deformable material arranged around said bucket element and said sliding annular member forming a second annular chamber for said drive fluid connected hydraulically to said first chamber, said annular element of deformable material having first and second annular edges fixedly sealed to said first and second moving elements, respectively, and said sliding connection communicating hydraulically with said second chamber.

2. A hydraulic tappet according to claim 1 wherein the duct supplying the drive fluid into the first chamber comprises a hole formed in a wall integral with the annular sliding member and the on-off member comprises a ball designed to close a seat on the hole, said ball being formed against said seat by a first spring housed in a bushing housed in the first chamber, said bushing being formed against the wall by a second spring located between the bucket and said wall.

3. A hydraulic tappet according to claim 1 wherein the first moving element comprises an essentialy flat, circular end wall and a cylindrical side wall forming a cavity, the outer surface of said first moving element sliding in a corresponding seat on the crankcase, the second moving element, the bucket, the annular sliding member and the deformable annular element being located in the cavity defined by the end and side walls of the first moving element.

4. A hydraulic tappet according to claim 1 including a third chamber for the driving fluid which is formed inside the annular sliding member and over the first chamber, said third chamber being located between said first chamber and the second chamber and along the hydraulic route between the first and second chambers.

5. A hydraulic tappet according to claim 1 including elastic means for keeping the annular element made of deformable material normally in a first deformed position in which the volume of the second chamber is minimum, so as to enable the drive fluid to flow from the second chamber to the first chamber.

6. A hydraulic tappet according to claim 5 wherein the elastic means comprises at least one spring inside the bucket for generating a force tending to displace said bucket axially away from the annular sliding member.

7. A hydraulic tappet designed for assembly on a drive and for controlling a valve on an internal combusion engine having a crankcase, said tappet comprising a first element moving in relation to said crankcase and a second element moving axially in relation to said first element; a first variable-volume chamber having an inlet duct for the passage of drive fluid being formed between said first and said second elements, said inlet duct being controlled by an on-off member in such a manner that the fluid flowing into the chamber causes one of said elements to move axially in relation to the remaining element and to vary the volume of said chamber, said second element comprising a bucket element connected by means of a sliding connection to a sliding annular member integral with said first element and to form said first chamber between said bucket element and said sliding annular member, an annular element made of deformable material arranged around said bucket element and said sliding annular member forming a second annular chamber for said drive fluid connected hydraulically to said first chamber, said annular element of deformable material having first and second annular edges connected in a sealed manner to said first and second moving elements, respectively, said sliding connection communicating hydraulically with said second chamber, and elastic means for keeping the annular element made of deformable material normally in a first deformed position in which the volume of the second chamber is minimum, so as to enable the drive fluid to flow from the second chamber to the first chamber, said elastic means comprising a plurality of flat springs, each acting on an outer surface of the deformable annular element and projecting radially inwardly from a ring connected to the first moving element.

8. A hydraulic tappet designed for assembly on a drive and for controlling a valve of an internal combustion engine having a crankcase, said tappet comprising a first element moving in relation to said crankcase and a second element moving axially in relation to said first element; a first variable-volume chamber having an inlet duct for passage of drive fluid being formed between said first and said second elements, said inlet duct being controlled by an on-off member in such a manner that the fluid flowing into the chamber causes one of said elements to move axially in relation to the remaining element and to vary the volume of said chamber, said second element comprising a bucket element connected by means of a sliding connection to a sliding annular member integral with said first element and to form said first chamber between said bucket element and said sliding annular member, an annular element made of deformable material arranged around said bucket element and said sliding annular member forming a second annular chamber for said drive fluid connected hydraulically to said first chamber, said annular element of deformable material having first and second annular edges connected in a sealed manner to said first and second moving elements, respectively, said sliding connection communicating hydraulically with said second chamber, elastic means for keeping the annular element made of deformable material normally in a first deformed position in which the volume of the second chamber is minimum, so as to enable the drive fluid to flow from the second chamber to the first chamber, said elastic means comprising a plurality of flat springs, each acting on an outer surface of the deformable annular element and projecting radially inwardly from a ring connected to the first moving element close to the first annular edge thereof, so as to lock the first annular edge to said first moving element.

9. A hydraulic tappet designed for assembly on a drive and for controlling a valve on an internal combustion engine having a crankcase, said tappet comprising a first element moving in relation to said crankcase and a second element moving axially in relation to said first element; a first variable-volume chamber having an inlet duct for passage of drive fluid being formed between said first and said second elements, said inlet duct being controlled by an on-off member in such a manner that the fluid flowing into the chamber causes one of said elements to move axially in relation to the remaining element and to vary the volume of said chamber, said second element comprising a bucket element connected by means of a sliding connection to a sliding annular member integral with said first element and to form said first chamber between said bucket element and said sliding annular member, an annular element made of deformable material arranged around said bucket element and said sliding annular member forming a second annular chamber for said drive fluid connected hydraulically to said first chamber, said annular element of deformable material having first and second annular edges fixedly sealed to said first and second moving elements, respectively, said sliding connection communicating hydraulically with said second chamber, and elastic means for keeping the annular element made of deformable material normally in a first deformed position in which a volume of the second chamber is minimum, so as to enable the drive fluid to flow from the second chamber to the first chamber, said elastic means comprising an annular spring arranged around the second annular edge of the deformable annular element so as to exert essentially radial pressure on the outer surface thereof.

10. A hydraulic tapped designed for assembly on a drive and for controlling a value on an internal combusion engine having a crankcase, said tappet comprising a first element moving in relation to said crankcase and a second element moving axially in relation to said first element; a first variable-volume chamber having an inlet duct for passage of drive fluid being formed between said first and said second elements, said inlet duct being controlled by an on-off member in such a manner that the fluid flowing into the chamber causes one of said elements to move axially in relation to the remaining element and to vary the volume of said chamber, said second element comprising a bucket element connected by means of a sliding connection to a sliding annular member integral with said first element and to form said first chamber between said bucket element and said sliding annular member, an annular element made of deformable material arranged around said bucket element and said sliding annular member forming a second annular chamber for said drive fluid connected hydraulically to said first chamber, said annular element of deformable material having first and second annular edges connected in a sealed manner to said first and second moving elements, respectively, said sliding connection communicating hydraulically with said second chamber, and the deformable annular element presenting circumferential undulations shaped so as to enable said annular element to assume an essentially cylindrical or conical shape when deformed, and to assume the cylindrical or conical shape when a volume of the first chamber is maximum and the bucket is at a maximum distance from the annular sliding member.

* * * * *